US006082458A

United States Patent [19]

Schnatzmeyer

[11] Patent Number: 6,082,458

[45] Date of Patent: Jul. 4, 2000

[54] FLOW CONTROL APPARATUS WITH SPECIFIC LATCHING MEANS FOR USE IN A SUBTERRANEAN WELL AND ASSOCIATED METHODS

[75] Inventor: Mark A. Schnatzmeyer, Lewisville, Tex.

[73] Assignee: Halliburton Energy Services, Inc., Dallas, Tex.

[21] Appl. No.: 09/347,587

[22] Filed: Jul. 1, 1999

Related U.S. Application Data

[63] Continuation of application No. 08/898,505, Jul. 21, 1997, Pat. No. 5,957,207.

[51] Int. Cl.[7] ..... E21B 34/14

[52] U.S. Cl. ..... 166/332.1; 166/317; 166/332.4; 166/386

[58] Field of Search ..... 166/373, 386, 166/332.4, 323, 332.1, 317, 322, 321; 137/627.5

[56] References Cited

U.S. PATENT DOCUMENTS

| | | | |
|---|---|---|---|
| 1,747,910 | 2/1930 | Siefarth | 137/107 |
| 4,062,406 | 12/1977 | Akkerman et al. | 166/323 |
| 4,254,832 | 3/1981 | Patton et al. | 166/332.4 |
| 5,156,220 | 10/1992 | Forehand et al. | 166/386 |
| 5,411,095 | 5/1995 | Ehlinger et al. | 166/317 |
| 5,957,207 | 9/1999 | Schnatzmeyer | 166/332.1 |

*Primary Examiner*—Eileen Dunn Lillis
*Assistant Examiner*—Sunil Singh
*Attorney, Agent, or Firm*—Paul I. Herman; Marlin R. Smith

[57] ABSTRACT

A flow control apparatus and associated methods of using provide enhanced longevity and reliability without requiring complex mechanisms. In a described embodiment, a choke for use within a subterranean well has multiple trim sets which may be selected by manipulation of an inner tubular cage. Additional features include provision of releasable latches to maintain the cage in a desired position, and utilization of biasing members to bias the cage toward a neutral position in which all of the trim sets are closed.

9 Claims, 10 Drawing Sheets

FLOW CONTROL APPARATUS WITH SPECIFIC LATCHING MEANS FOR USE IN A SUBTERRANEAN WELL AND ASSOCIATED METHODS

This is a continuation of application Ser. No. 08/898,505, filed Jul. 21, 1997, now U.S. Pat. No. 5,957,207, the disclosure of which is incorporated by reference herein in its entirety.

CROSS-REFERENCE TO RELATED APPLICATIONS

This application is related to a copending application filed on even date herewith, entitled FLOW CONTROL APPARATUS FOR USE IN A SUBTERRANEAN WELL AND ASSOCIATED METHODS, having Mark A. Schnatzmeyer as an inventor thereof and an attorney docket number of 970332 U1 USA, and to another copending application filed on even date herewith, entitled VARIABLE CHOKE FOR USE IN A SUBTERRANEAN WELL, having Brett Bouldin and Napoleon Arizmendi as inventors thereof and an attorney docket number of 970031 U1 USA. The disclosures of the copending applications are incorporated herein by this reference.

BACKGROUND OF THE INVENTION

The present invention relates generally to apparatus utilized to control fluid flow in a subterranean well and, in an embodiment described herein, more particularly provides a choke for selectively regulating fluid flow into or out of a tubing string disposed within a well.

In a subsea well completion it is common for the well to be produced without having a rig or production platform on site. In this situation, it is well known that any problems that occur with equipment or other aspects of the completion may require a rig to be moved on site, in order to resolve the problem. Such operations are typically very expensive and should be avoided if possible.

An item of equipment needed, particularly in subsea completions, is a flow control apparatus which is used to throttle or choke fluid flow into a production tubing string. The apparatus would be particularly useful where multiple zones are produced and it is desired to regulate the rate of fluid flow into the tubing string from each zone. Additionally, regulatory authorities may require that rates of production from each zone be reported, necessitating the use of the apparatus or other methods of determining and/or controlling the rate of production from each zone. Safety concerns may also dictate controlling the rate of production from each zone.

Such an item of equipment would also be useful in single zone completions. For example, in a single wellbore producing from a single zone, an operator may determine that it is desirable to reduce the flow rate from the zone into the wellbore to limit damage to the well, reduce water coning and/or enhance ultimate recovery.

Downhole valves, such as sliding side doors, are designed for operation in a fully closed or fully open configuration and, thus, are not useful for variably regulating fluid flow therethrough. Downhole chokes typically are provided with a fixed orifice which cannot be closed. These are placed downhole to limit flow from a certain formation or wellbore. Unfortunately, conventional downhole valves and chokes are also limited in their usefulness because intervention is required to change the fixed orifice or to open or close the valve.

What is needed is a flow control apparatus which is rugged, reliable, and long-lived, so that it may be utilized in completions without requiring frequent service, repair or replacement. To compensate for changing conditions, the apparatus should be adjustable without requiring slickline, wireline or other operations which need a rig for their performance, or which require additional equipment to be installed in the well. The apparatus should be resistant to erosion, even when it is configured between its fully open and closed positions, and should be capable of accurately regulating fluid flow. The apparatus should include provisions which continue to permit its use in its fully open and closed positions, even if its ability to otherwise regulate fluid flow has been compromised, so that production from the well may be continued. Additionally, it would be desirable for the apparatus to include features which permit its periodic recalibration, which permit use of redundant trim sets, and which permit selection from among multiple flow port sets in order to regulate in an extended range of flow conditions.

Such a downhole variable choking device would allow an operator to maximize reservoir production into the wellbore. It would be useful in surface, as well as subsea, completions, including any well where it is desired to control fluid flow, such as gas wells, oil wells, and water and chemical injection wells. In sum, in any downhole environment for controlling flow of fluids.

It is accordingly an object of the present invention to provide such a flow control apparatus which permits variable downhole flow choking as well as the ability to shut off fluid flow, and to provide associated methods of controlling fluid flow within a subterranean well.

SUMMARY OF THE INVENTION

In carrying out the principles of the present invention, in accordance with an embodiment thereof, an apparatus is provided which is a choke for use within a subterranean well. The described choke provides ruggedness, simplicity, reliability, longevity, and redundancy in regulating fluid flow into or out of a tubing string within the well.

In broad terms, a choke is provided which includes a tubular inner cage, an outer housing, a trim set, and a compression spring. The cage is slidingly disposed within the housing and the trim set is carried externally on the cage and includes portions of the cage. Manipulation of the cage by a conventional actuator causes the trim set to partially open, fully open, and close as desired. The spring biases the cage toward a position in which the trim set is closed.

In another aspect of the present invention, the choke is provided with multiple trim sets, thereby providing selectivity and redundancy in use of the trim sets. The cage is displaced by the actuator in one direction to use a first trim set, and is displaced by the actuator in an opposite direction to use a second trim set. Corresponding multiple compression springs bias one of the trim sets closed while the other is opened, and bias the cage toward a neutral position in which both trim sets are closed.

In yet another aspect of the present invention, a latch is provided in the choke for maintaining the cage in a desired position. In the illustrated embodiment, multiple latches are utilized, each latch corresponding to one of the two trim sets. The latches are releasable, thereby permitting the choke to be utilized in a normal fashion after the latches have been engaged.

The trim sets utilize a design which both impedes erosion and wear of the choke components, and, in combination with the cage, permits commingling of fluids produced from multiple zones of the well, or control of fluids injected into multiple zones. Commingling of fluids produced, or control of fluids injected, may be precisely regulated by manipulation of the cage with the actuator.

These and other aspects, features, objects, and advantages of the present invention will be more fully appreciated following careful consideration of the detailed description and accompanying drawings set forth hereinbelow.

DETAILED DESCRIPTION

Representatively illustrated in FIGS. 1A–1D is a choke 10 which embodies principles of the present invention. In the following description of the choke 10 and other apparatus and methods described herein, directional terms, such as "above", "below", "upper", "lower", etc., are used for convenience in referring to the accompanying drawings. Although the choke 10 and other apparatus, etc., shown in the accompanying drawings are depicted in successive axial sections, it is to be understood that the sections form a continuous assembly. Additionally, it is to be understood that the various embodiments of the present invention described herein may be utilized in various orientations, such as inclined, inverted, horizontal, vertical, etc., without departing from the principles of the present invention.

Figure 1A:
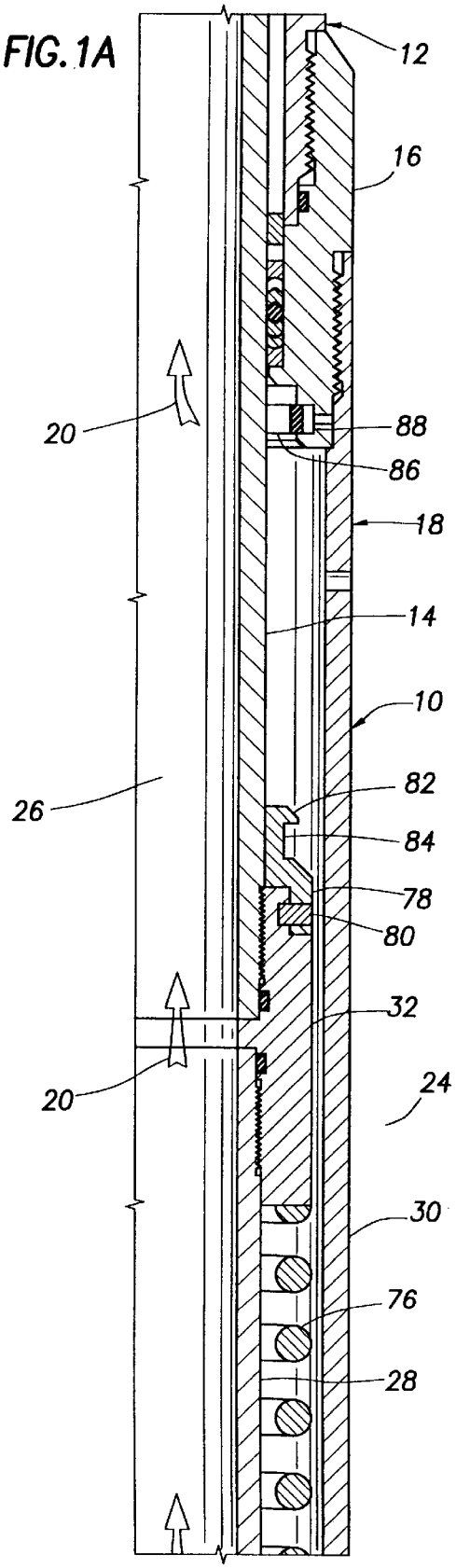
FIGS. 1A–1D are quarter-sectional views of successive axial portions of a choke embodying principles of the present invention, the choke being shown in a configuration in which it is initially run into a subterranean well attached to an actuator and interconnected in a production tubing string.

The choke 10 is threadedly and sealingly attached to an actuator 12, a lower portion of which is shown in FIG. 1A. In a manner which will be more fully described hereinbelow, the actuator 12 is used to operate the choke 10. The actuator 12 may be hydraulically, electrically, mechanically, magnetically or otherwise controlled without departing from the principles of the present invention. The representatively illustrated actuator 12 is a SCRAMS ICV hydraulically controlled actuator manufactured by, and available from, PES, Incorporated of The Woodlands, Texas. It includes an inner tubular mandrel 14 which is axially displaceable relative to the choke 10 by appropriate hydraulic pressure applied to the actuator 12 via control lines (not shown) extending to the earth's surface.

In a method of using the choke 10, the choke and actuator 12 are positioned within a subterranean well as part of a production tubing string 18 extending to the earth's surface. As representatively illustrated in FIGS. 1A–1D, fluid (indicated by arrows 20) may flow axially through the choke 10 and actuator 12, and to the earth's surface via the tubing string 18. The fluid 20 may, for example, be produced from a zone of the well below the choke 10. In that case, an additional portion of the tubing string 18 including a packer (not shown) would be attached in a conventional manner to a lower adaptor 22 of the choke 10 and set in the well in order to isolate the zone below the choke from other zones of the well, such as a zone in fluid communication with an area 24 surrounding the choke.

In a manner more fully described hereinbelow, the choke 10 enables accurate regulation of fluid flow between the external area 24 and an internal axial fluid passage 26 extending through the choke. In another method of using the choke 10, multiple chokes may be installed in the tubing string 18, with each of the chokes corresponding to a respective one of multiple zones intersected by the well, and with the zones being isolated from each other external to the tubing string. Thus, the choke 10 also enables accurate regulation of a rate of fluid flow from each of the multiple zones, with the fluids being commingled in the tubing string 18.

It is to be understood that, although the tubing string 18 is representatively illustrated in the accompanying drawings with fluid 20 entering the lower adaptor 22 and flowing upwardly through the fluid passage 26, the lower connector 22 may actually be closed off or otherwise isolated from such fluid flow in a conventional manner, such as by attaching a bull plug thereto, or the fluid 20 may be flowed downwardly through the fluid passage 26, for example, in order to inject the fluid into a formation intersected by the well, without departing from the principles of the present invention. For convenience and clarity of description, the choke 10 and associated tubing string 18 will be described hereinbelow as it may be used in a method of producing fluids from multiple zones of the well, the fluids being commingled within the tubing string, and it being expressly understood that the choke 10 may be used in other methods without departing from the principles of the present invention.

An upper connector 16 of the choke 10 is threadedly and sealingly attached to the actuator 12, with the inner mandrel 14 extending downwardly through the upper connector. The mandrel 14 is axially slidingly and sealingly received in the upper connector 16. To operate the choke 10, the mandrel 14 is axially displaced relative to the upper connector 16, in order to axially displace an inner axially extending and generally tubular cage member 28 relative to an outer housing 30 of the choke. The mandrel 14 is sealingly interconnected to the cage 28 by means of a threaded upper coupling 32.

The housing 30 includes a series of axially spaced apart openings 34, which are also circumferentially distributed about the housing. The openings 34 are formed through the housing 30 and thereby provide fluid communication between the area 24 external to the choke 10 and the interior of the housing. The housing 30 also includes a radially reduced interior portion 36, thereby forming upper and lower internal shoulders 38, 40, respectively, above and below the portion 36. The housing 30 is threadedly attached to the upper connector 16 and to a lower connector 39, which, in turn, is sealingly and threadedly attached to the lower adaptor 22.

The cage 28 extends downwardly from the upper coupling 32 to a lower coupling 41. The lower coupling 41 is threadedly and sealingly attached to the cage 28 and a generally tubular extension 42. The extension 42 is axially slidingly and sealingly received within the lower connector 39, and extends downwardly into the lower adaptor 22.

A pair of oppositely oriented trim sets 44, 46 are disposed externally on, and are carried by, the cage 28. As used herein, the term "trim set" is used to describe an element or combination of elements which perform a function of regulating fluid flow. In the illustrated embodiment of the invention, the upper trim set 44 includes, but is not limited to, a sleeve 48 and a seat 50. Similarly, the lower trim set 46 includes, but is not limited to, a sleeve 52 and a seat 54. The applicant prefers that the sleeves 48, 52, seats 50, 54 and cage 28 be configured in some respects similar to those utilized in a Master Flo Flow Trim manufactured by, and available from, Master Flo of Ontario, Canada, although other trim sets may be utilized without departing from the principles of the present invention.

Each of the sleeves 48, 52 includes an axially extending and internally inclined lip 56 adjacent an externally inclined seal surface 58. The lips 56 act to prevent, or at least greatly reduce, erosion of the seal surfaces 58, among other benefits. The seal surfaces 58 are cooperatively shaped to sealingly engage seal surfaces 60 formed on the seats 50, 54, and, in the configuration of the choke 10 shown in FIG. 1B, the seal surfaces 58 are contacting and sealingly engaging the seal surfaces 60. Preferably, the seal surfaces 58, 60 are formed of hardened metal or carbide for erosion resistance, although other materials, such as elastomers, resilient materials, etc., may be utilized without departing from the principles of the present invention. However, it is to be understood that it is not necessary for the choke 10 to include the seal surfaces 58, 60 in keeping with the principles of the present invention.

The seats 50, 54 are threadedly and sealingly attached to each other, with the seal surface 60 of the upper seat 50 facing generally upward for sealing engagement with the seal surface 58 on the upper sleeve 48, and with the seal surface 60 of the lower seat 54 facing generally downward for sealing engagement with the seal surface 58 on the lower sleeve 52. Thus, the trim sets 44, 46 are oppositely oriented with respect to each other.

The seats 50, 54 axially straddle a radially enlarged portion 62 formed externally on the cage 28. The lower seat 54 sealingly engages the portion 62, with a seal 64 carried on the portion contacting the lower seat, and the lower seat extending axially, and radially between, the upper seat 50 and the portion 62. It will, thus, be readily appreciated that the upper and lower seats 50, 54 are attached to the cage 28, such that, as the cage is axially displaced by the actuator mandrel 14, the seats are displaced therewith.

Each of the sleeves 48, 52 carries an internal seal 66 therein. The seals 66 sealingly engage the cage 28.

The cage 28 has two axially spaced apart sets of flow ports 68, and two axially spaced apart sets of comparatively larger flow ports 70, formed radially therethrough. Each of the sets of ports 68, 70 includes two circumferentially spaced apart and oppositely disposed ports, although only one of each is visible in FIG. 1B. Of course, other numbers of ports may be utilized in the flow port sets 68, 70 without departing from the principles of the present invention. The trim sets 44, 46 include the flow port sets 68, 70.

Figure 1B:
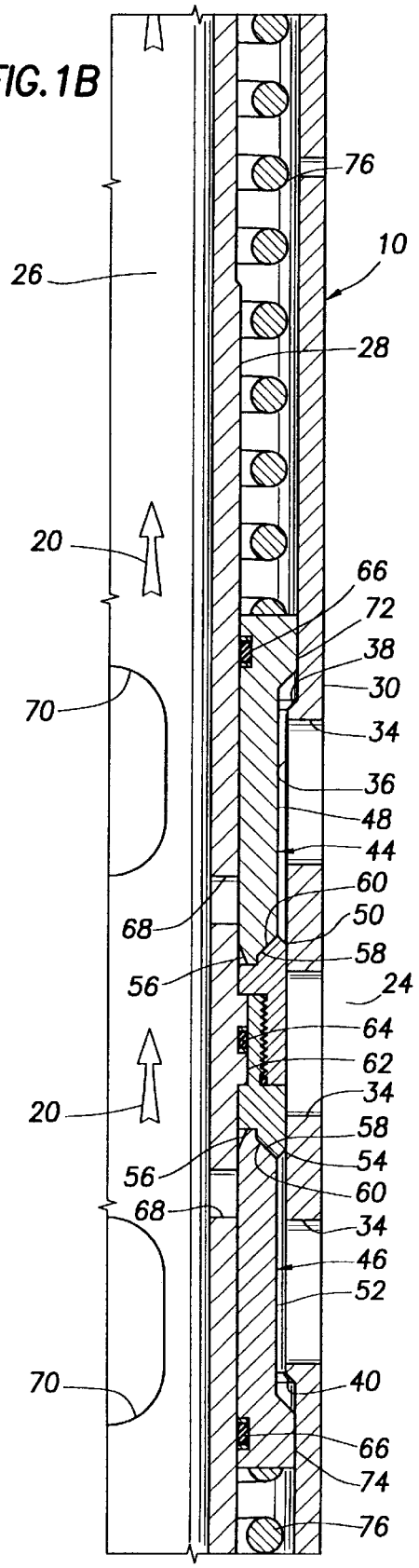
Figure 1C:
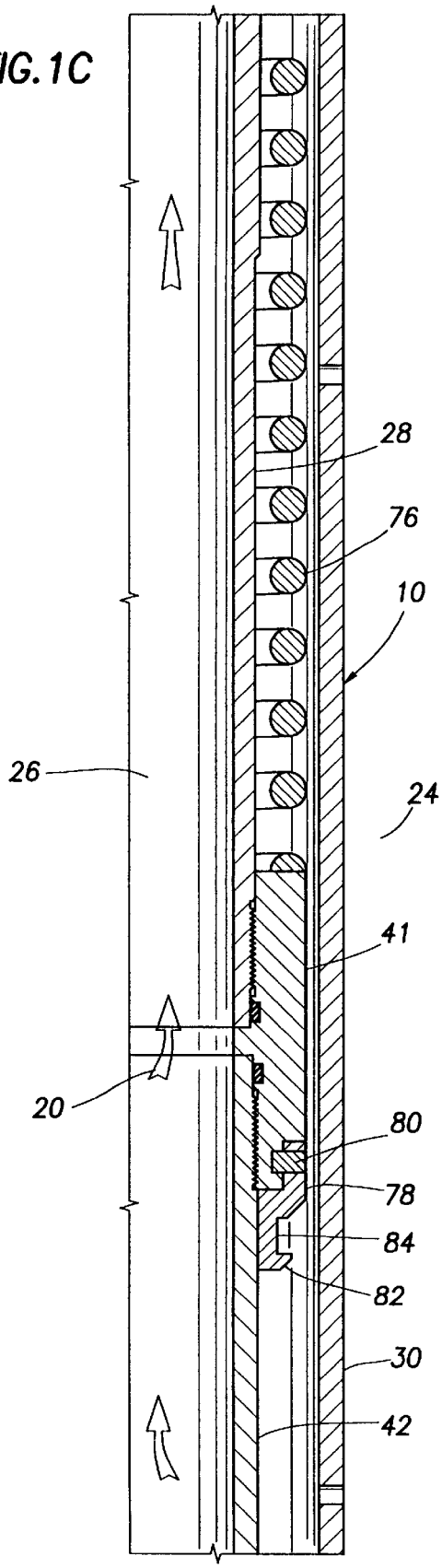
Figure 1D:
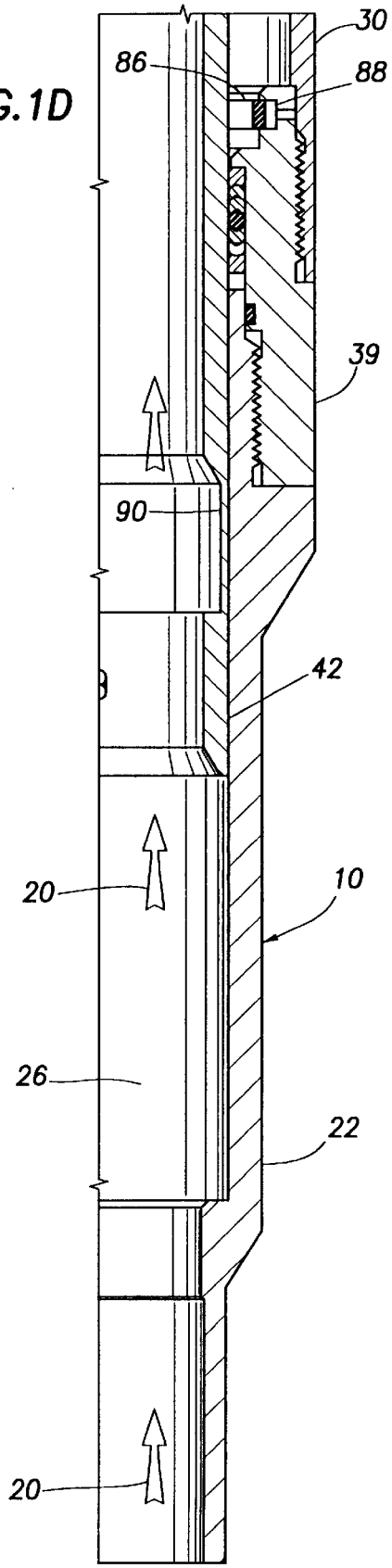
Figure 2A:
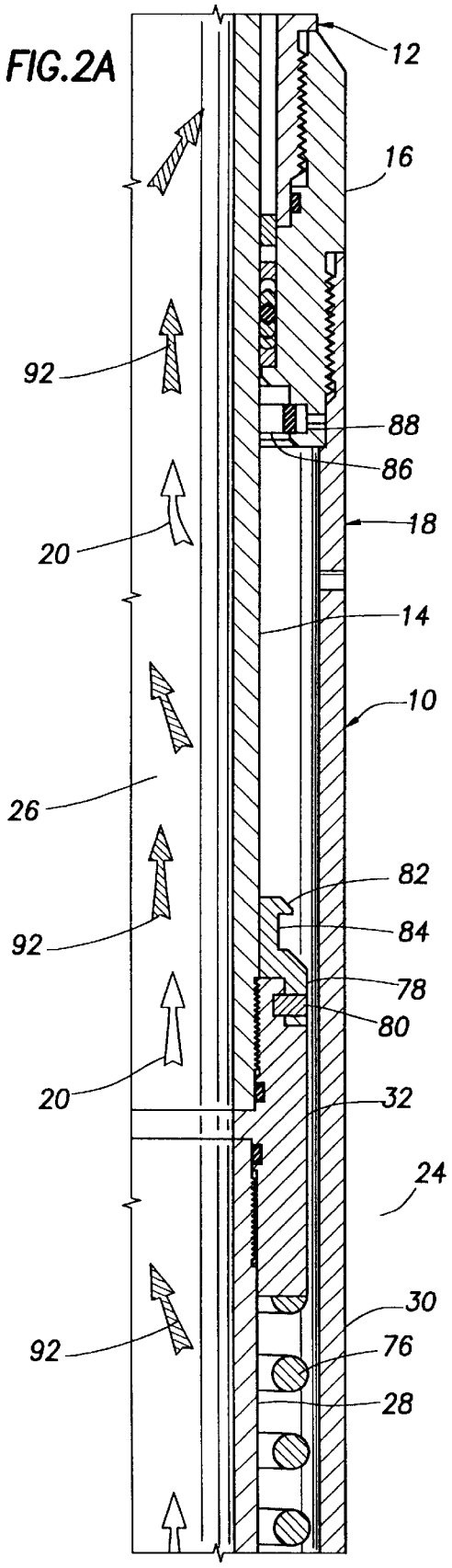
FIGS. 2A–2D are quarter-sectional views of successive axial portions of the choke of FIGS. 1A–1D, the choke being shown in a configuration in which a first trim set has been partially opened.
Figure 2B:
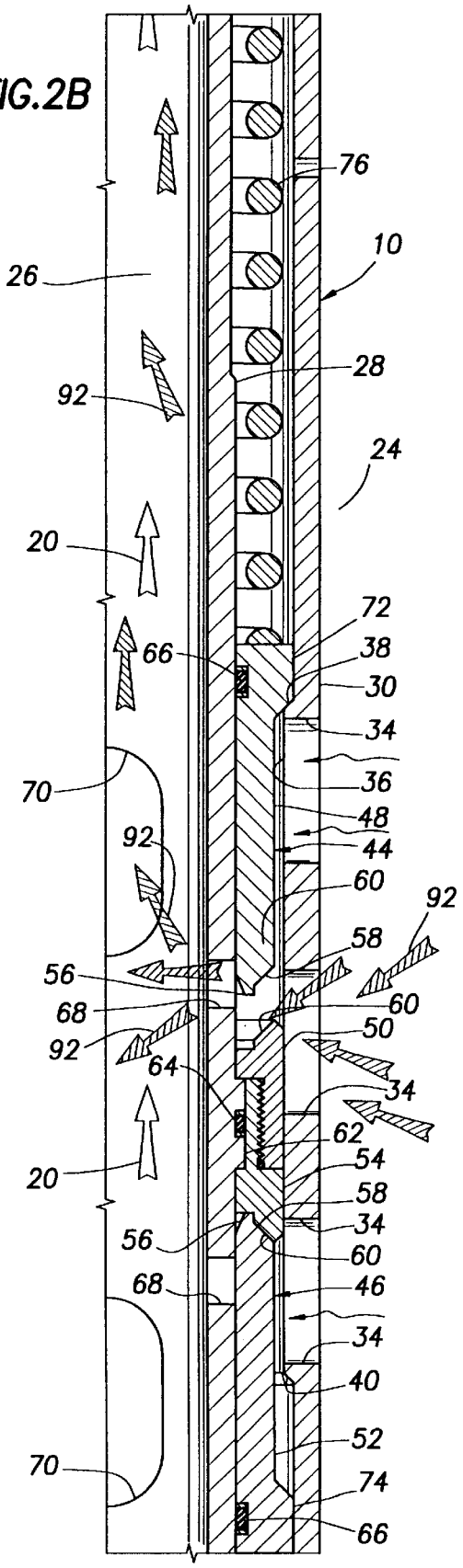
Figure 2C:
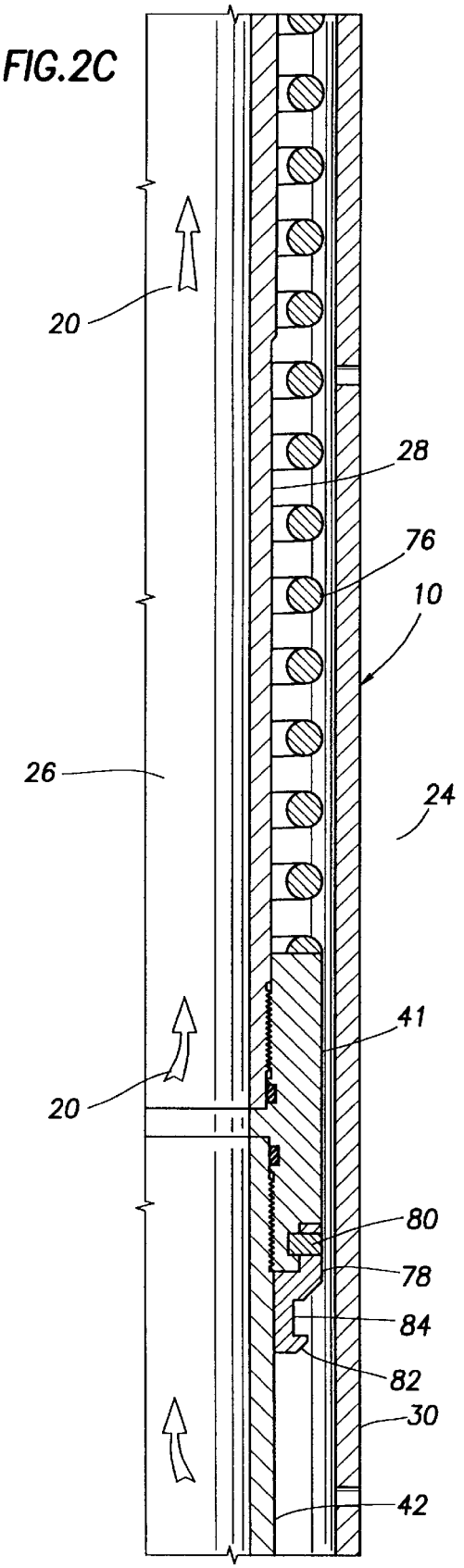
Figure 2D:
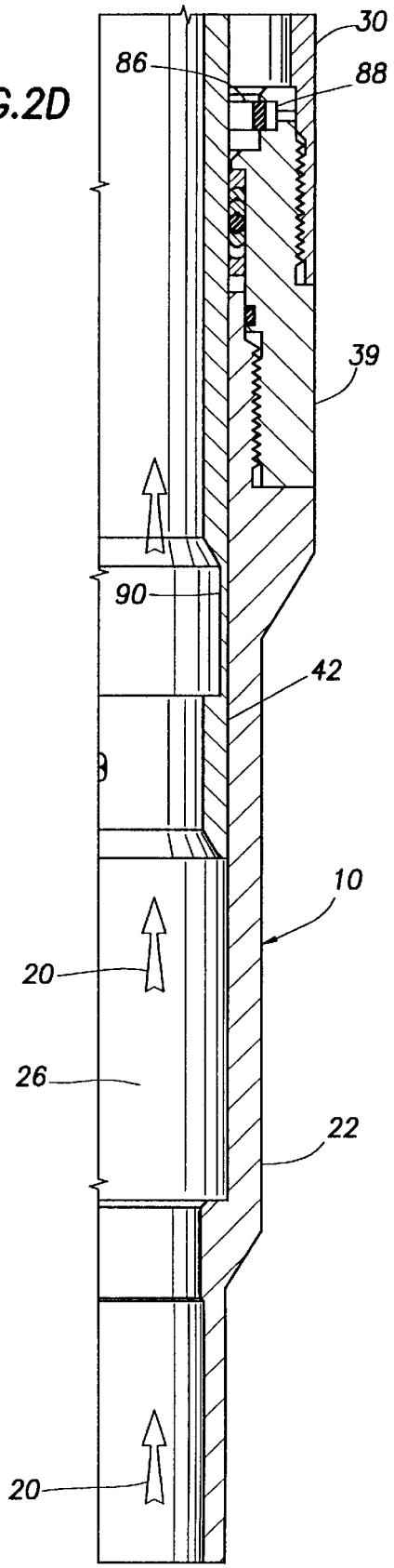

In the configuration of the choke 10 shown in FIG. 1B, the upper sets of the ports 68, 70 are axially between the seal 66 on the upper sleeve 48 and the seat 50, and the lower sets of the ports 68, 70 are axially between the seal 66 on the lower sleeve 52 and the seat 54. Thus, fluid communication between the external area 24 and the flow passage 26 through the flow ports 68, 70 is prevented by the sleeves 48, 52. However, it is to be clearly understood that it is not necessary for the sleeves 48, 52 to completely prevent fluid communication between the external area 24 and the flow passage 26 in keeping with the principles of the present invention.

As representatively illustrated in the accompanying drawings, the flow port sets 68 are comparatively small, in order to provide an initial relatively highly restricted fluid flow therethrough when one of the sleeves 48, 52 is displaced axially away from its corresponding seat 50 or 54, as more fully described hereinbelow. Additionally, the flow port sets 68 are shown identically dimensioned and positioned (albeit axially spaced apart). However, it is to be understood that the flow port sets 68 may be otherwise dimensioned, otherwise positioned, otherwise dimensioned with respect to each other, and otherwise positioned with respect to each other, without departing from the principles of the present invention. For example, the upper flow port set 68 may actually have larger or smaller ports, may have larger or smaller ports than the lower flow port set 68, may be positioned differently on the cage 28, may be positioned differently with respect to the lower flow port set 68, etc. Similar changes may be made to the flow port sets 70. Indeed, it is not necessary for the cage 28 to have differently configured sets of flow ports 68, 70 at all. Thus, the flow port sets 68, 70 shown in the accompanying drawings are merely illustrative and additions, modifications, deletions, substitutions, etc., may be made thereto without departing from the principles of the present invention.

The flow port sets 68 shown in FIG. 1B are identical to each other, the flow port sets 70 are identical to each other, and the trim sets 44, 46 are identical to each other, although oppositely disposed, in order to provide redundancy in the flow characteristics thereof. Alternatively, any of these may be easily modified to provide nonidentical flow characteristics. For example, the upper flow port sets 68, 70 may be comparatively larger or smaller than the lower flow port sets 68, 70, in order to provide for a wider range of flow characteristics. As another example, although the trim sets 44, 46 are configured for regulating flow from the area 24 to the flow passage 26 (e.g., for producing fluid), the lower trim set 46 may be turned inside out or otherwise configured for regulating fluid flow from the flow passage 26 to the area 24 (e.g., for injecting fluid).

Each of the sleeves 48, 52 is biased axially toward its respective seat 50, 54 by a biasing member 76. As representatively illustrated, the biasing members 76 are identically configured compression springs, but it is to be understood that other biasing members, such as resilient devices, etc., may be utilized, and the biasing members may be different from each other, without departing from the principles of the present invention. The upper spring 76 is installed axially between the upper coupling 32 and the upper sleeve 48, and the lower spring 76 is installed axially between the lower coupling 41 and the lower sleeve 52.

As shown in FIG. 1B, the upper sleeve 48 is prevented from displacing axially downward relative to the cage 28 by axial contact between the upper seal surfaces 58, 60. Similarly, the lower sleeve 52 is prevented from displacing axially upward relative to the cage 28 by axial contact between the lower seal surfaces 58, 60. Thus, with a compressive preload in each of the springs 76, the sleeves 48, 52 sealingly engage the seats 50, 54, and the choke 10 is in its closed configuration as shown in FIGS. 1A–1D.

The upper sleeve 48 is also prevented from displacing axially downward appreciably relative to the housing 30 due to axial contact between the shoulder 38 and a radially enlarged portion 72 formed externally on the sleeve. Similarly, the lower sleeve 52 is prevented from displacing axially upward appreciably relative to the housing 30 due to axial contact between the shoulder 40 and a radially enlarged portion 74 formed externally on the sleeve. Thus, the radially reduced portion 36 of the housing 30 is positioned axially between the radially enlarged portions 72, 74 of the sleeves 48, 52 and limits axial displacement of each of them.

As shown in FIG. 1B, the axial distance between the radially enlarged portions 72, 74 is somewhat larger than the axial extent of the radially reduced portion 36. The applicant has provided this axial difference or gap in order to ensure that neither of the sleeves 48, 52 is prevented from axially contacting its respective seat 50, 54. However, it is to be understood that this gap or difference is not necessary in a flow control apparatus made according to the principles of the present invention.

Since the springs 76 are biasing against the upper and lower couplings 32, 40, which are attached to the cage 28, and since the sleeve radially enlarged portions 72, 74 axially straddle the radially reduced portion 36 of the housing 30, it will be readily apparent to one of ordinary skill in the art that the springs 76 act to bias the cage 28 relative to the housing 30. Furthermore, the configuration of these elements, as shown in the accompanying drawings and described hereinabove, tends to bias the elements so that the upper sleeve 48 sealingly engages the upper seat 50 and the lower sleeve 52 sealingly engages the lower seat 54, with no external forces applied. However, as will be more fully described hereinbelow, the cage 28 may be axially displaced relative to the housing 30 by, for example, axial displacement of the actuator mandrel 14, in order to disengage one of the sleeves 48, 52 from its respective seat 50 or 54.

With the springs 76 biasing both of the sleeves 48, 52 into sealing contact with their respective seats 50, 54 as described above, the choke 10 is in its closed configuration as shown in FIGS. 1A–1D, fluid flow being prevented through each of the flow port sets 68, 70. From a different perspective, the cage 28 is in a neutral position with respect to the housing 30, since the cage 28 may be displaced axially upward relative to the housing, to thereby cause the lower sleeve radially enlarged portion 74 to contact the shoulder 40 and further compress the lower spring 76, or the cage may be displaced axially downward relative to the housing, to thereby cause the upper sleeve radially enlarged portion 72 to contact the shoulder 38 and further compress the upper spring 76. However, it is to be clearly understood that it is not necessary, in keeping with the principles of the present invention, for the springs 76 to be included in the choke 10, for the sleeves 48, 52 to sealingly engage the seats 50, 54 in the closed configuration of the choke, nor for the cage 28 to be biased toward a neutral position.

Note that, if the cage 28 is displaced axially downward relative to the housing 30 after the radially enlarged portion 72 contacts the shoulder 38, the upper sleeve 48 will be prevented from further downward displacement and the upper sealing surfaces 58, 60 will disengage, thereby permitting fluid flow through the upper flow port sets 68, 70. Similarly, if the cage 28 is displaced axially upward relative to the housing 30 after the radially enlarged portion 74 contacts the shoulder 40, the lower sleeve 52 will be prevented from further upward displacement and the lower sealing surfaces 58, 60 will disengage, thereby permitting fluid flow through the lower flow port sets 68, 70. Thus, the trim sets 44, 46 are selectively openable by axially displacing the cage 28 from its neutral position, one of the trim sets 44 being opened when the cage 28 is displaced axially downward relative to the housing 30, and the other of the trim sets 46 being opened when the cage is displaced axially upward relative to the housing. Additionally, note that when one of the trim sets 44, 46 is opened, the other one is closed by the biasing force of its respective spring 76. Therefore, one of the trim sets 44, 46 may be selectively utilized for an initial period of time, and/or for certain flow characteristics, and the other one of the trim sets may be selectively utilized for a subsequent period of time, and/or for different flow characteristics.

Each of the couplings 32, 40 has a latch member 78 releasably attached thereto with a shear member 80. Each of the latch members 78 has an external inclined face 82 and an external circumferential recess 84 formed thereon. Each of the inclined faces 82 is configured for cooperatively engaging and radially outwardly expanding a circumferential, generally C-shaped, snap ring 86 carried in an internal recess 88 formed in each of the upper and lower connectors 16, 38. After the inclined face 82 has radially expanded the snap ring 86, the latch member 78 may further enter the snap ring, until the snap ring radially contracts into the recess 84. At that point, the latch member 78, coupling 32 or 40, and the cage 28 are prevented from axially displacing relative to the housing 30.

Note that when the latch member 78 is engaged with the snap ring 86 and remains attached to the coupling 37 or 40, one of the trim sets 44 or 46 will be opened, since the cage 28 must be axially displaced relative to the housing 30 from the neutral position in order to engage the latch member with the snap ring. In this manner, the latch member 78 may be utilized to maintain one of the trim sets 44, 46 in an open position. This feature may be advantageous in circumstances in which there is a failure or problem with the actuator 12, choke 10, or other equipment associated with the well. For example, if a problem is experienced with the actuator 12 or its associated control lines, such that the mandrel 14 cannot be axially displaced in a normal fashion by the actuator, a slickline or wireline having a conventional shifting tool attached thereto may be conveyed into the tubing string 18, engaged with a shifting profile 90 formed internally on the extension 42, and utilized to axially displace the cage 28 relative to the housing 30 so that the upper or lower latch member 78 engages one of the snap rings 86, thus permitting a selected one of the trim sets 44, 46 to be opened.

Of course, other methods of maintaining the cage 28 in a desired position relative to the housing 30 may be utilized without departing from the principles of the present invention. For example, detents, etc., may be configured to cooperatively engage the cage 28 and/or housing 30. Additionally, other methods of maintaining one or both of the trim sets 44, 46 in an open position may be utilized, for example, a latching device may be associated with either or both of the trim sets 44, 46, etc., to maintain the trim set(s) in a desired axial relationship to the cage 28. Note that it is not necessary for a shifting tool to be used to axially displace the latch member 78 into engagement with the snap ring 86, since, if the actuator 12 is operational, the mandrel 14 may be used to axially displace the latch member.

After one of the latch members 78 has been engaged with a corresponding one of the snap rings 86, the choke 10 may be returned to normal operation (i.e., the cage 28 being permitted to axially displace relative to the housing 30) by shearing the shear member 80 to thereby release the latch member from the coupling 32 or 40. The shear member 80 may be sheared by utilizing the actuator 12 to apply an axial force to the coupling 32 or 40, applying an axial force using a shifting tool engaged with the shifting profile 90, etc. Thus, if a problem occurs with the well or its associated equipment, the choke 10 may be maintained closed by the biasing forces of the springs 76 as described above, the choke may be maintained with a selected one of the trim sets 44, 46 open, the choke may subsequently be maintained with the other one of the trim sets open, and the choke may be returned to normal operation, for example, when the problem has been resolved.

Referring additionally now to FIGS. 2A–2D, the choke 10 is representatively illustrated in an open configuration in which the upper flow port set 68 is partially exposed to direct fluid flow between the area 24 and the fluid passage 26. In this configuration, the cage 28 has been axially downwardly displaced relative to the housing 30, the radially enlarged portion 72 has contacted the shoulder 38, and the sleeve 48 is thereby prevented from further downward displacement. The upper seal surfaces 58, 60 are no longer sealingly engaged, thus permitting fluid communication between the area 24 and the fluid passage 26.

It will be readily apparent to a person of ordinary skill in the art that, with suitable modification, e.g., interchanging the cage 28 and sleeve 48, the sleeve may instead be displaced relative to the cage, to permit fluid communication between the area 24 and the fluid passage 26. Alternatively, both the cage 28 and sleeve 48 could be displaced relative to the housing 30 and to each other. No matter the manner in which relative displacement occurs between the cage 28 and sleeve 48, such relative displacement permits variable choking of fluid flow through the flow ports 68, 70 and sealing engagement between the seal surfaces 58, 60 when desired.

The lower trim set 46 remains closed, since the lower spring 76 continues to bias the lower seal surfaces 58, 60 into sealing engagement. Thus, the lower trim set 46 is not exposed to erosive conditions due to flow of fluid (indicated by arrows 92) between the area 24 and the fluid passage 26. In this manner, the lower trim set 46 may be reserved for subsequent use, for example, when the upper trim set 44 has been eroded significantly or otherwise becomes unusable, or when flow characteristics change, etc.

The sleeves 48, 52 are preferably closely fitted externally about the cage 28. Thus, the fluid 92 flows almost exclusively through the smaller upper flow port set 68, even though some fluid may pass between the sleeve 48 and cage 28 to flow through the larger upper flow port set 70. The upper lip 56 is disposed partially obstructing the upper flow port set 68. It is believed that the presence of the lip 56 extending outwardly from the sleeve 48 acts to reduce erosion of the sleeve, particularly the seal surface 58, and also aids in reducing erosion of the cage 28 adjacent the flow port sets 68, 70 when the fluid 92 is flowing therethrough. The lip 56 deflects the fluid flow path away from the seal surface 58.

Additionally, it is believed that the diametrically opposite orientation of the openings of each of the flow port sets 68, 70 acts to reduce erosion of the cage 28, in that inwardly directed fluid 92 flowing through one of two diametrically opposing openings will interfere with the fluid flowing inwardly through the other opening, thereby causing the fluid velocity to decrease and, accordingly, cause the fluid's kinetic energy to decrease. Thus, the impinging fluid flows in the center of the cage 28 dissipate the fluid energy onto itself and reduces erosion by containing turbulence and throttling wear within the cage. The sealing surfaces 58, 60 are isolated from the flow paths and sealing integrity is maintained, even though erosion may take place at the ports 68, 70.

Preferably, each of the flow port sets 68, 70 includes individual ports of equal size provided in pairs, as shown in the accompanying drawings, or greater numbers, as long as the geometry of the ports is arranged so that impingement results between fluid flowing through the ports, and so that such impingement occurs at or near the center of the cage 28 and away from the seal surfaces 58, 60, ports, and other flow controlling elements of the choke 10. As an example of alternate preferred arrangements of the flow port sets 70, three ports of equal size and geometry could be provided, spaced around the circumference of the cage 28 at 120 degrees apart from each other, or four ports of equal size and geometry could be provided, spaced around the circumference of the cage at 90 degrees apart from each other, etc.

It is a particular benefit of the embodiment of the invention described herein that portions thereof may erode during normal use, without affecting the ability of the choke 10 to be closed to fluid flow therethrough. For example, the lips 56, the flow port sets 68, 70 and the interior of the cage 28, etc., may erode without damaging the seal surfaces 58, 60. Thus, where it is important for safety purposes to ensure the fluid tight sealing integrity of the wellbore, the choke 10 preserves its ability to shut off fluid flow therethrough even where its fluid choking elements have been degraded.

It will be readily appreciated by one of ordinary skill in the art that the lower trim set 46 may be similarly opened by axially displacing the cage 28 upward to displace the lower sleeve 52 downward relative to the cage. It will also be readily appreciated that such axial displacement of the cage 28, whether upwardly or downwardly directed, may be accomplished by a number of methods, for example, by using the actuator mandrel 14, by using a shifting tool engaged with the shifting profile 90, etc.

It is a particular benefit of the present invention that the fluids 20, 92 may be commingled within the fluid passage 26, and the rate of flow of each may be accurately regulated utilizing one or more of the chokes 10 as described hereinabove. For example, another choke, similar to the illustrated choke 10, may be installed below the choke 10 to regulate the rate of flow of the fluid 20, while the choke 10 regulates the rate of fluid flow of the fluid 92. Alternatively, where the choke 10 is used in an injection operation, the choke may be utilized to regulate the rate of fluid flow outward through the flow port sets 68, 70, and, alone or in combination with additional chokes, may be utilized to accurately regulate fluid flow rates into multiple zones in a well. Of course, the choke 10 may be useful in single zone completions to regulate fluid flow into or out of the zone.

Referring additionally to FIGS. 3A–3D, the choke 10 is representatively illustrated in a fully open configuration in which the upper sleeve 48 has completely uncovered both of the upper flow port sets 68, 70. The fluid 92 is, thus, permitted to flow unobstructed inwardly through the upper flow port sets 68, 70 and into the fluid passage 26. The arrows indicating the fluid 92 are comparatively larger than the corresponding arrows shown in FIGS. 2A–2D, in order to convey that more of the fluid 92 is admitted into the fluid passage 26.

Preferably, the ports 68, 70 are aligned with the openings 34 in the fully open configuration of the choke 10 and, furthermore, it is preferred that the ports 68, 70 and openings 34 are similarly sized in order to minimize resistance to flow therethrough, reduce friction losses and minimize erosion of the choke 10. However, it is to be clearly understood that it is not necessary in keeping with the principles of the present invention for the ports 68, 70 to be directly aligned with the openings 34, nor for the ports 68, 70, or any combination of them to be identical in size, shape or number with the openings 34. If the ports 68, 70 are not aligned with the openings 34 in the fully open configuration of the choke 10, then preferably a sufficiently large annular space is provided between the exterior of the cage 28 and the interior of the housing 30 so that fluid flow therebetween has minimum resistance.

Figure 3A:
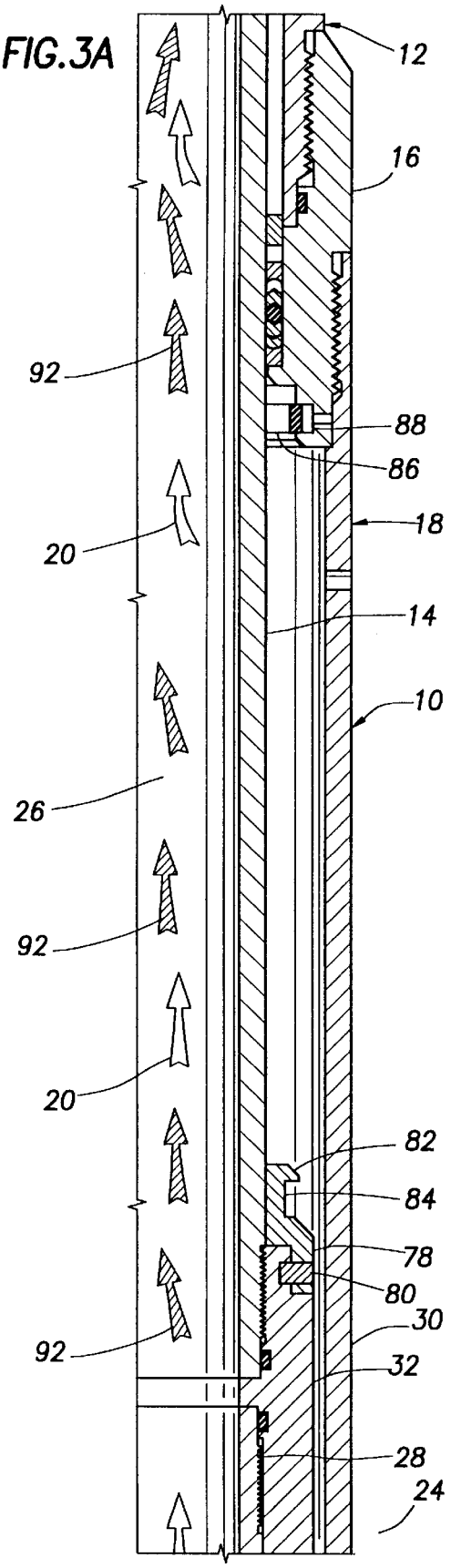
FIGS. 3A–3D are quarter-sectional views of successive axial portions of the choke of FIGS. 1A–1D, the choke being shown in a configuration in which the first trim set has been fully opened.
Figure 3B:
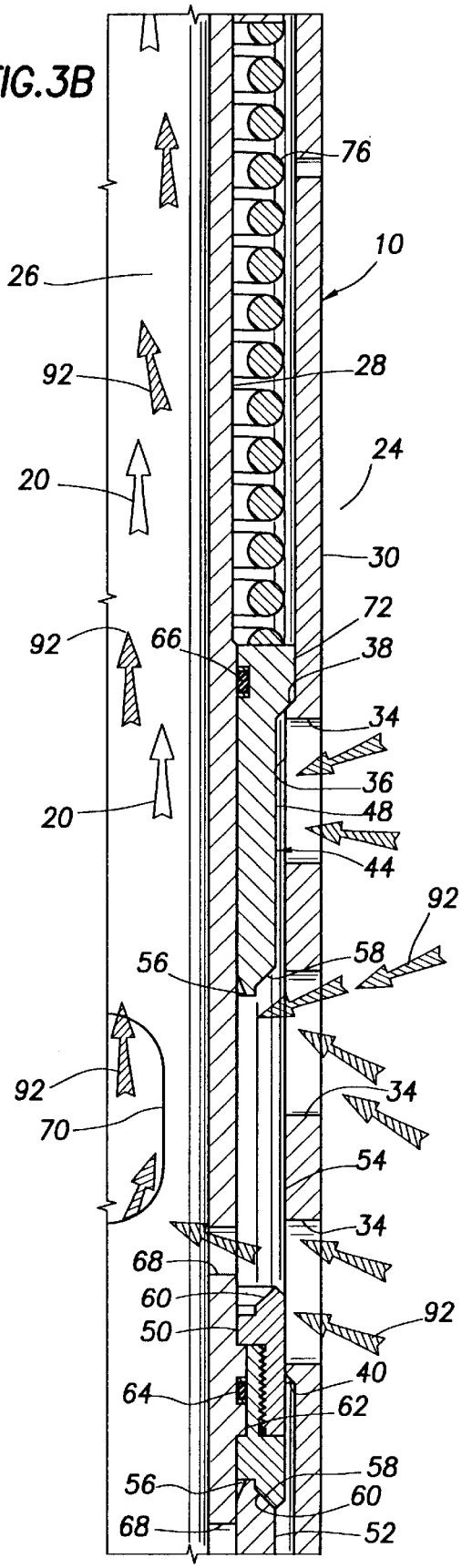
Figure 3C:
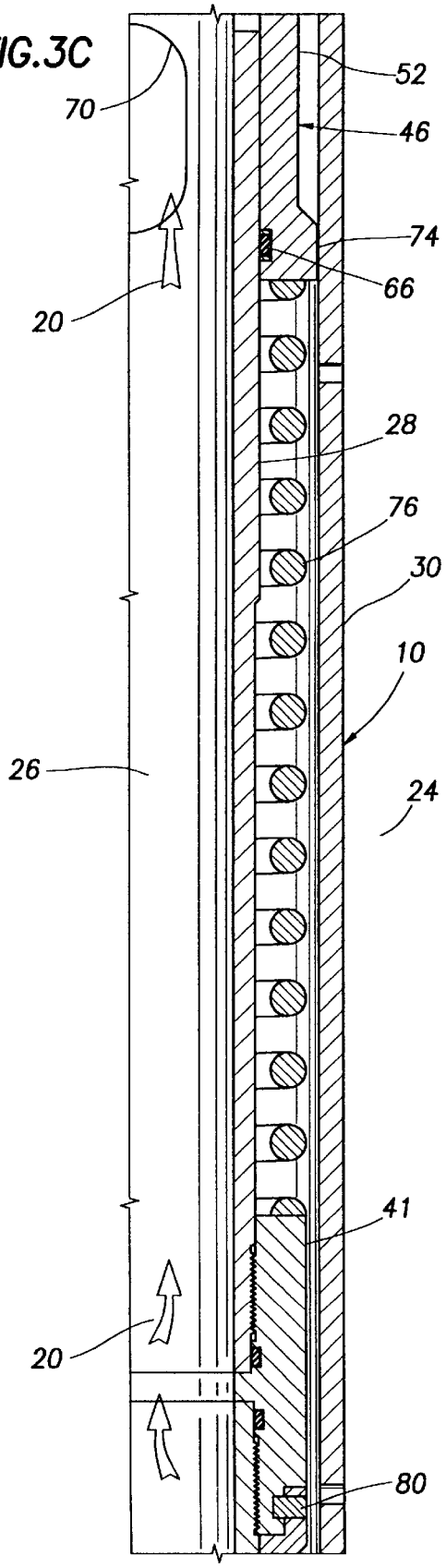
Figure 3D:
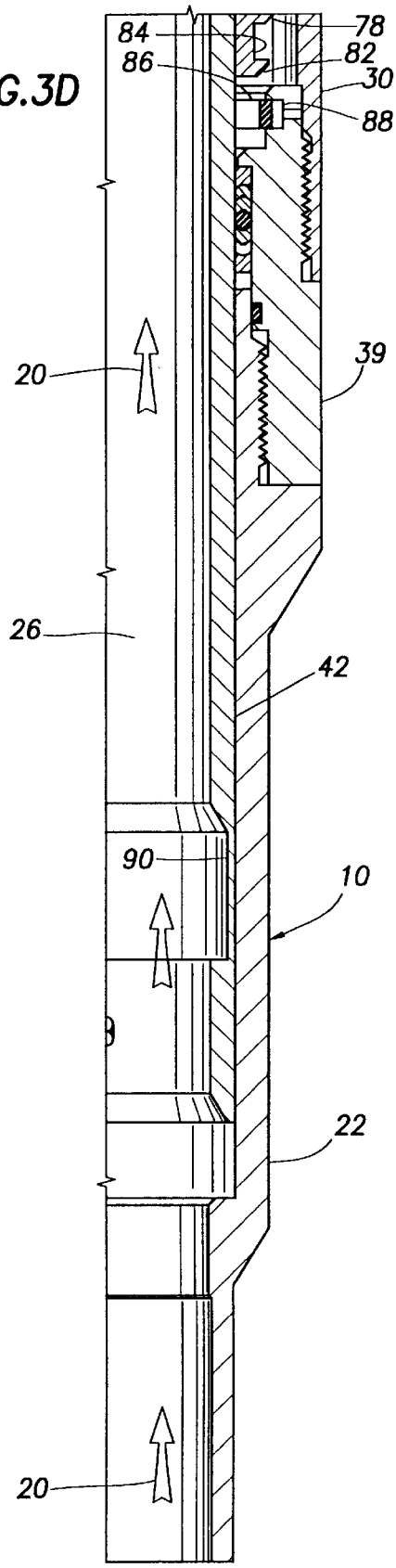
Figure 4A:
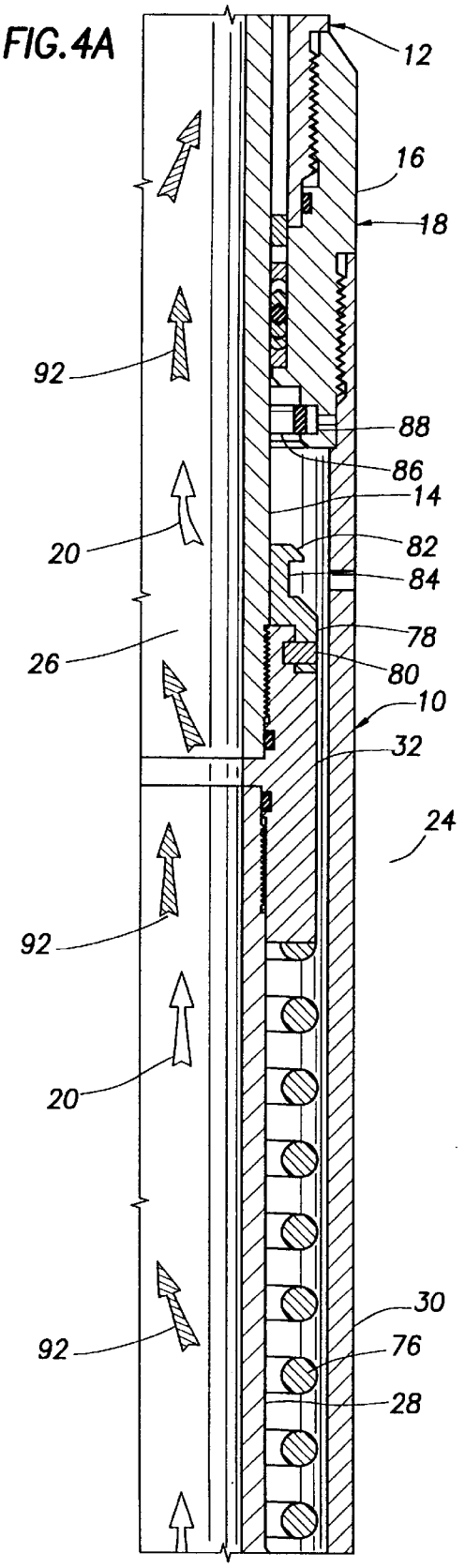
FIGS. 4A–4D are quarter-sectional views of successive axial portions of the choke of FIGS. 1A–1D, the choke being shown in a configuration in which a second trim set has been opened.
Figure 4B:
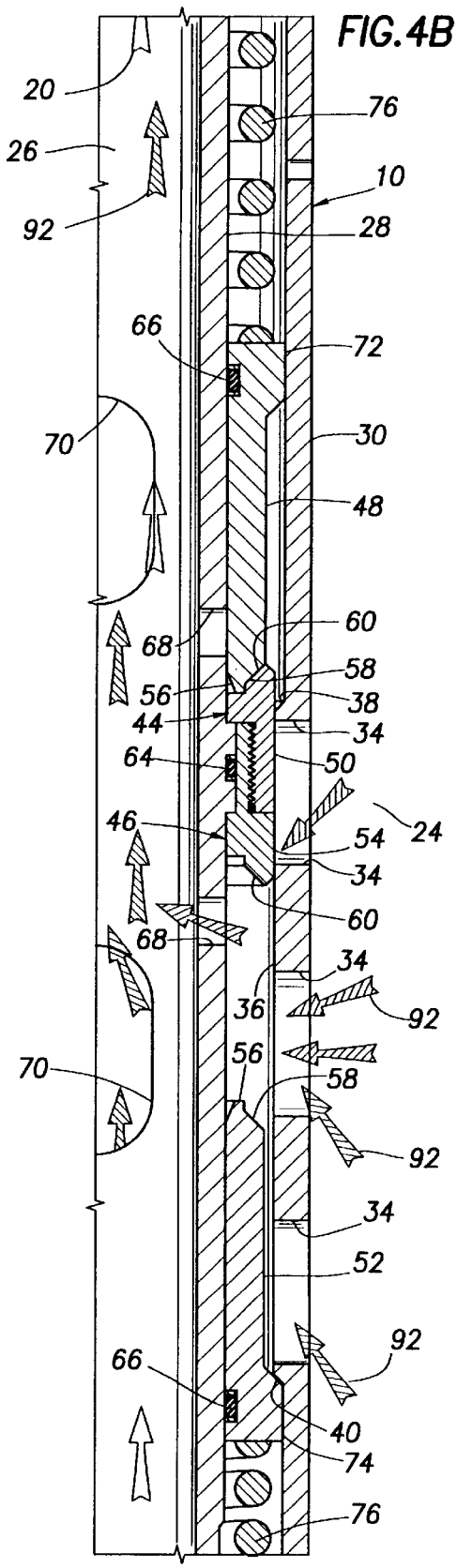
Figure 4C:
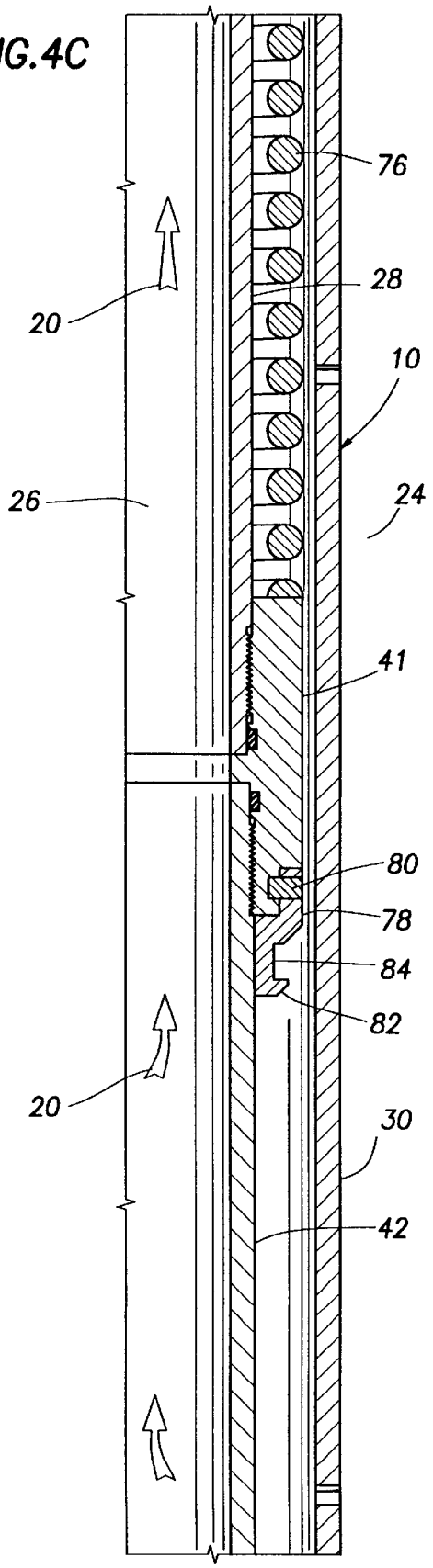
Figure 4D:
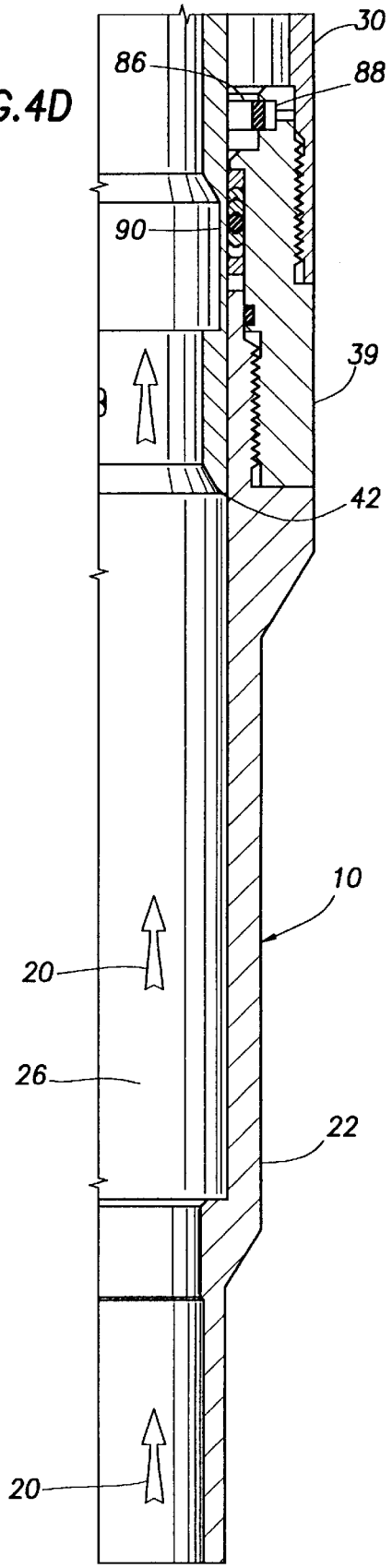
Figure 5A:
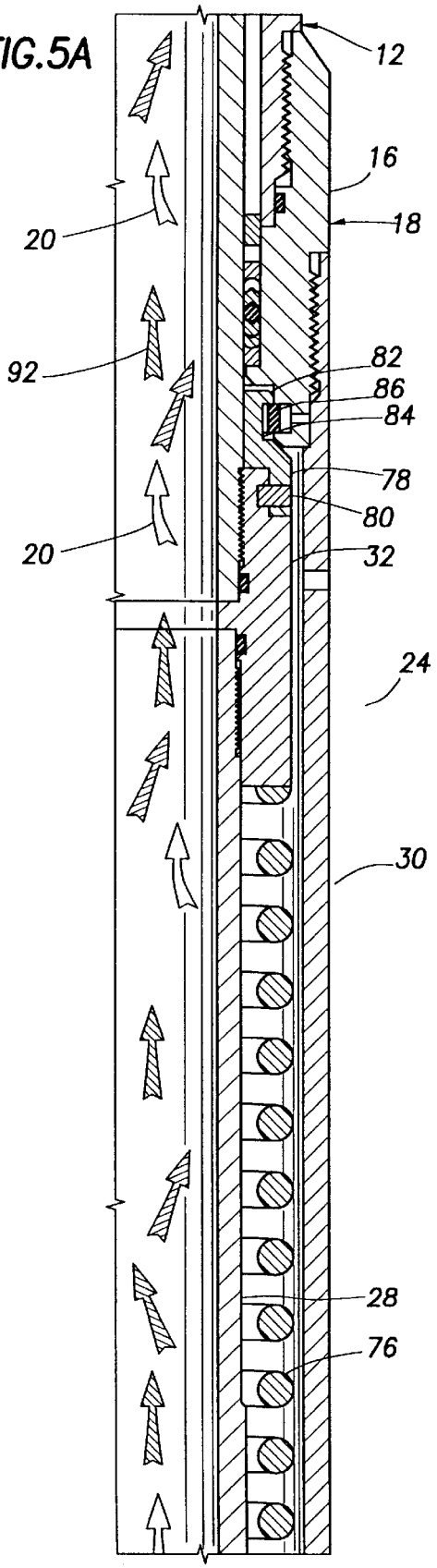
FIGS. 5A–5D are quarter-sectional views of successive axial portions of the choke of FIGS. 1A–1D, the choke being shown in a configuration in which a releasable latch has been engaged to maintain the second trim set fully open.
Figure 5B:
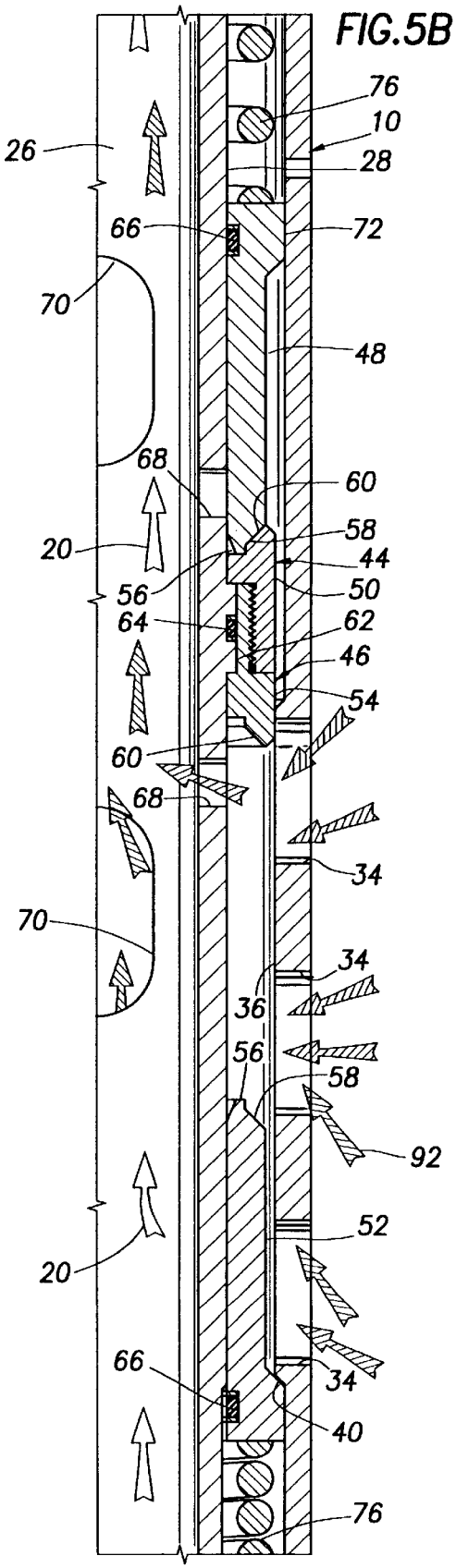
Figure 5C:
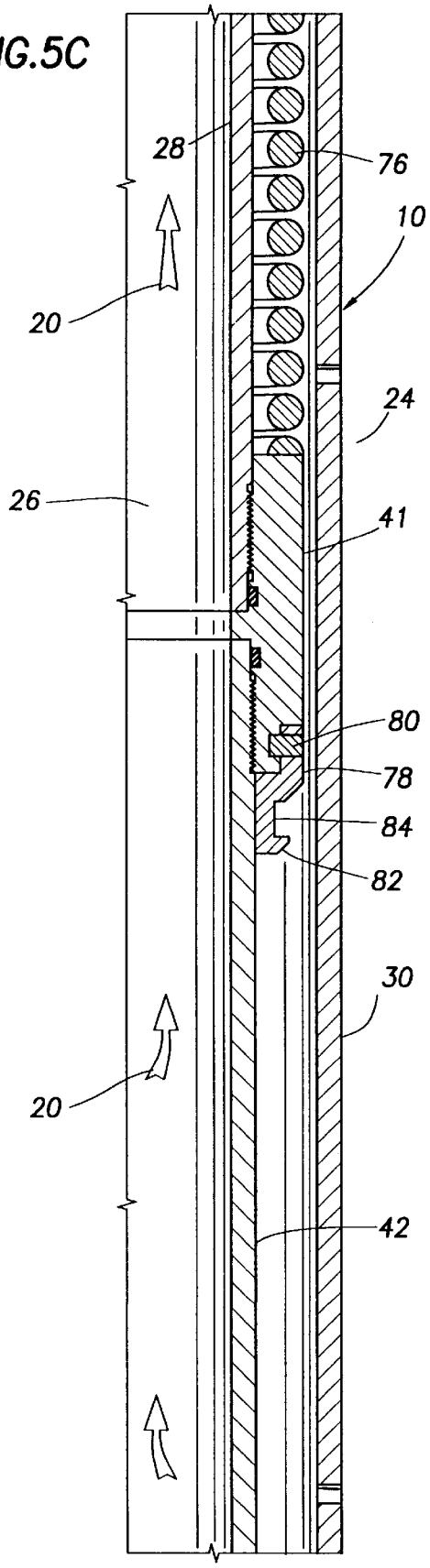
Figure 5D:
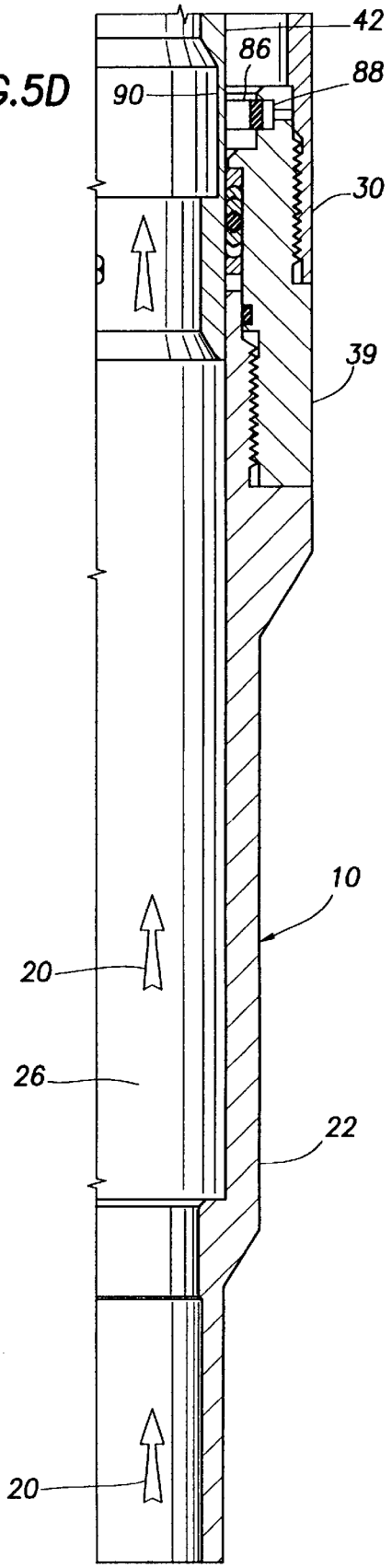

Although FIG. 3B representatively illustrates the cage 28 positioned so that the ports 68 are directly aligned with corresponding ones of the openings 34, it is to be clearly understood that such direct alignment (for both flow port sets 68, 70) is not necessary in operation of the choke 10. However, to achieve such direct alignment between the ports 68, 70 and openings 34, the cage 28 and/or mandrel 14 may be rotationally secured to the housing 30 in a manner which prevents misalignment between the ports and openings. For example, a radially outwardly extending projection or key may be provided on the cage 28 and/or mandrel 14 and cooperatively slidingly engaged with a groove or keyway formed internally on the housing 30 and/or actuator 12, etc., to thereby prevent relative circumferential displacement between the cage and housing.

It will be readily apparent to one of ordinary skill in the art that the relative proportions of the fluids 20, 92 produced through the tubing string 18 may be conveniently regulated by selectively permitting greater or smaller fluid flow rates through the upper or lower trim set 44 or 46.

Referring additionally now to FIGS. 4A–4D, the choke 10 is representatively illustrated with the cage 10 displaced axially upward from its neutral position, thereby opening the lower trim set 46. Comparing FIGS. 4A–4D to FIGS. 3A–3D, note that, with the trim sets 44, 46 and flow port sets 68, 70 being identically dimensioned and oppositely configured, a similar rate of flow of the fluid 92 may be achieved. Thus, the lower trim set 46 may be used to provide similar flow regulation as the upper trim set 44. Additionally, one of the trim sets 44, 46 may be used to recalibrate the rate of fluid flow through the other one of the trim sets by periodically closing the trim set which has been in use, and opening the unused trim set by displacing the cage 28 a known axial distance to produce a desired rate of fluid flow therethrough. Alternatively, the lower trim set 46 and/or lower flow port sets 68, 70 may be differently dimensioned and/or differently configured in order to provide different flow characteristics, or to compensate for changed conditions in the fluid 92, changed conditions in the zone from which the fluid 92 is produced, etc.

Referring additionally now to FIGS. 5A–5D, the choke 10 is representatively illustrated with the cage 28 maintained in an upwardly displaced position relative to its neutral position, the lower trim set 46 being fully opened. The upper latch member 78 is engaged with the snap ring 86, thereby preventing axially downward displacement of the cage 28. For this purpose, preferably the shear member 80 will shear at an axial force greater than the difference between the biasing forces of the springs 76 in this configuration.

As described above, the cage 28 may be displaced to this position by the actuator mandrel 14, by a shifting tool engaged with the shifting profile 90, or by any other suitable method without departing from the principles of the present invention. In order to return the choke 10 to normal operation, an axially downwardly directed force may be applied to the coupling 32 to shear the shear member 80 and release the latch member 78 from the coupling. This axially directed force may be applied by the actuator mandrel 14, by a shifting tool engaged with the shifting profile 90, or by any other suitable method without departing from the principles of the present invention.

Thus has been described the choke 10 and methods of controlling fluid flow within the well using the choke, which provide redundancy, reliability, ruggedness, longevity, and do not require complex mechanisms. Of course, modifications, substitutions, additions, deletions, etc., may be made to the exemplary embodiment described herein, which changes would be obvious to one of ordinary skill in the art, and such changes are contemplated by the principles of the present invention. For example, the actuator mandrel 14 may be releasably attached to the upper coupling 32, so that, if the actuator 12 becomes inoperative, the cage 28 may be displaced independently from the mandrel. As another example, the cage 28 may be displaced circumferentially, rather than axially, in order to selectively open multiple trim sets, such as trim sets positioned radially about the cage, rather than being positioned axially relative to the cage. Accordingly, the foregoing detailed description is to be clearly understood as being given by way of illustration and example only, the spirit and scope of the present invention being limited solely by the appended claims.

What is claimed is:

1. Flow control apparatus operatively positionable within a subterranean well, the apparatus comprising:

an outer housing;

a mandrel displaceable relative to the housing to control fluid flow through a sidewall of the housing; and a releasable latch device operative to releasably secure the mandrel against displacement relative to the housing, the latch device including a first latch member secured to the mandrel and a second latch member secured to the housing, wherein displacement of the mandrel in a first direction relative to the housing a predetermined distance causes the first latch member to engage the second latch member, thereby releasably securing the mandrel against displacement relative to the housing, and wherein a predetermined force applied to the mandrel releases the first latch member for displacement relative to the mandrel.

2. The apparatus according to claim 1, wherein the mandrel is released for displacement relative to the housing when the first latch member is released for displacement relative to the mandrel.

3. Flow control apparatus operatively positionable within a subterranean well, the apparatus comprising:

an outer housing;

a first trim set operable to regulate fluid flow through a sidewall of the housing;

a mandrel displaceable relative to the housing to operate the first trim set;

a first releasable latch device operable to releasably secure the mandrel in a first position relative to the housing in which the first trim set is fully open; and a second trim set operable to regulate fluid flow through the housing sidewall, the second trim set being fully closed when the mandrel is in the first position relative to the housing.

4. Flow control apparatus operatively positionable within a subterranean well, the apparatus comprising:

an outer housing;

a first trim set operable to regulate fluid flow through a sidewall of the housing;

a mandrel displaceable relative to the housing to operate the first trim set;

a first releasable latch device operable to releasably secure the mandrel in a first position relative to the housing in which the first trim set is fully open;

a second trim set operable to regulate fluid flow through the housing sidewall; and a second releasable latch device operable to releasably secure the mandrel in a second position relative to the housing in which the second trim set is fully open.

5. The apparatus according to claim 4, wherein the first trim set is fully closed when the mandrel is in the second position relative to the housing.

6. Flow control apparatus operatively positionable within a subterranean well, the apparatus comprising:

an outer housing;

a first trim set operable to regulate fluid flow through a sidewall of the housing;

a mandrel displaceable relative to the housing to operate the first trim set; and a first releasable latch device operable to releasably secure the mandrel in a first position relative to the housing in which the first trim set is fully open, the first latch device including first and second latch members, the first latch member being engageable with the second latch member to secure the mandrel against displacement relative to the housing, and the first latch member being releasably secured to the mandrel by a shear member, and wherein the mandrel is releasable for displacement relative to the housing by applying a predetermined force to the mandrel to shear the shear member when the first and second latch members are engaged.

7. A method of operating a flow control device in a subterranean well, the method comprising the steps of:

interconnecting the flow control device in a tubular string installed in the well, the flow control device including a housing, a mandrel and a latch device operative to releasably secure the mandrel against displacement relative to the housing;

displacing the mandrel relative to the housing, thereby operating the flow control device to regulate fluid flow through the housing;

operating the latch device, by displacing the mandrel in a first direction relative to the housing, to releasably secure the mandrel against displacement relative to the housing; and releasing the latch device by applying a predetermined force to the mandrel and shearing a shear member releasably securing a latch member of the latch device to the mandrel.

8. Flow control apparatus operatively positionable within a subterranean well, the apparatus comprising:

an outer housing;

a trim set operable to regulate fluid flow through a sidewall of the housing;

a mandrel displaceable relative to the housing to operate the trim set; and a releasable latch device operable to releasably secure the mandrel relative to the housing, the latch device including first and second cooperatively engageable latch members, the first latch member being axially displaceable with the mandrel, and the second latch member being radially displaceable relative to the housing and axially retained relative to the housing when the mandrel displaces axially relative to the housing.

9. The apparatus according to claim 8, wherein the latch device is released by displacing one of the first and second latch members relative to the mandrel.

* * * * *